US009282602B2

(12) United States Patent
Balakrishnan

(10) Patent No.: US 9,282,602 B2
(45) Date of Patent: Mar. 8, 2016

(54) LIGHT DRIVER CONTROL SYSTEM

(71) Applicant: Power Integrations, Inc., San Jose, CA (US)

(72) Inventor: Balu Balakrishnan, Saratoga, CA (US)

(73) Assignee: Power Integrations, Inc., San Jose, CA (US)

( * ) Notice: Subject to any disclaimer, the term of this patent is extended or adjusted under 35 U.S.C. 154(b) by 185 days.

(21) Appl. No.: 13/797,685

(22) Filed: Mar. 12, 2013

(65) Prior Publication Data

US 2014/0265896 A1 Sep. 18, 2014

(51) Int. Cl.
*H05B 33/08* (2006.01)

(52) U.S. Cl.
CPC ..... *H05B 33/0815* (2013.01); *H05B 33/0842* (2013.01)

(58) Field of Classification Search
CPC .... H05B 37/02; H05B 33/08; H05B 33/0806; H05B 33/0815; H05B 33/0818; H05B 33/0842; H05B 33/0845
USPC ..... 315/200 R, 209 R, 224, 225, 287, 291, 315/307, 308
See application file for complete search history.

(56) References Cited

U.S. PATENT DOCUMENTS 5,107,184 A * 4/1992 Hu et al. ..... 315/291
2008/0157939 A1 7/2008 Sutardja
2011/0248835 A1* 10/2011 Speegle et al. ..... G08C 19/02 340/12.32
2013/0293137 A1* 11/2013 Jennings et al. ..... 315/224

OTHER PUBLICATIONS

EP Application No. 14158497.9—European Office Action, mailed Jun. 4, 2014 (6 pages).
European Application No. 14158497.9—European Search Report, mailed May 22, 2014 (3 pages).

* cited by examiner

*Primary Examiner* — Thai Pham
(74) *Attorney, Agent, or Firm* — Blakely Sokoloff Taylor & Zafman LLP

(57) ABSTRACT

A system for controlling a light source includes a control circuit to be coupled to an ac source to receive an ac signal. The control circuit includes an input controller coupled to receive an input control signal and dimming command circuitry coupled to the input controller and coupled to receive the ac signal. The dimming command circuitry is coupled to remove one or more portions of a predetermined duration from the ac signal followed by a substantially full ac signal in response to the input control signal. A lighting driver circuit is to be coupled to a light source and coupled to receive the ac signal from the control circuit. The lighting driver circuit is coupled to drive the light source to have a light output adjusted in response to the removed one or more portions of the predetermined duration from the ac signal by the dimming command circuitry.

26 Claims, 8 Drawing Sheets

LIGHT DRIVER CONTROL SYSTEM

BACKGROUND INFORMATION

1. Field of the Disclosure

The present invention relates generally to circuits that drive light sources. More specifically, the present invention relates to circuits that drive light sources that may include dimming circuitry.

2. Background

As alternatives to incandescent light bulbs become more affordable and increase in popularity, many traditional incandescent light bulbs are being replaced by alternative light sources. One example of an alternative light source is light emitting diode (LED) lighting. Many LED light sources are designed to be compatible with existing sockets that were originally designed to work with conventional incandescent light bulbs so that the LED light sources are "drop-in" replacements. To utilize the existing wiring, many ac-dc LED driver circuits are designed to operate and drive the LED light sources when the ac power to the LED driver circuits is controlled by a conventional light switch or a conventional dimmer.

Dimmers are used in a variety of residential and commercial applications to vary the brightness of lights. However, often dimmers are triac-based dimmers that function by varying the percentage of time or the portion of each ac half cycle of an ac input signal that is removed from an ac input signal supplying power to a light source. When triac-based dimmers remove portions of each ac half cycle of an ac input signal, sharp switching edges are generated. These switching edges create electromagnetic interference (EMI). EMI is a disturbance that interrupts radio, television and cell phone signals and presents an increasing problem as more and more devices (e.g. printers, cameras, headphones/headsets, computers, etc.) communicate wirelessly.

Triac-based dimmers also lower the power factor of the energy grid by distorting input current waveforms. Like EMI, power factor is an increasingly important aspect of lighting products being installed in residential and commercial lighting applications. A low power factor increases power loss and imposes additional infrastructure costs on power utility providers. Recognizing the size of these costs, legislation has placed requirements on power factor around the world.

Triac-based dimmers also present dimming range problems, especially for alternative light sources. Triac-based dimmers remove a large portion of each ac half cycle of an ac input signal when low light output is required. As a result of large portions being removed from the signal, light sources are starved for power, which tends to cause light flicker in low light output conditions.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DETAILED DESCRIPTION

Figure 1:
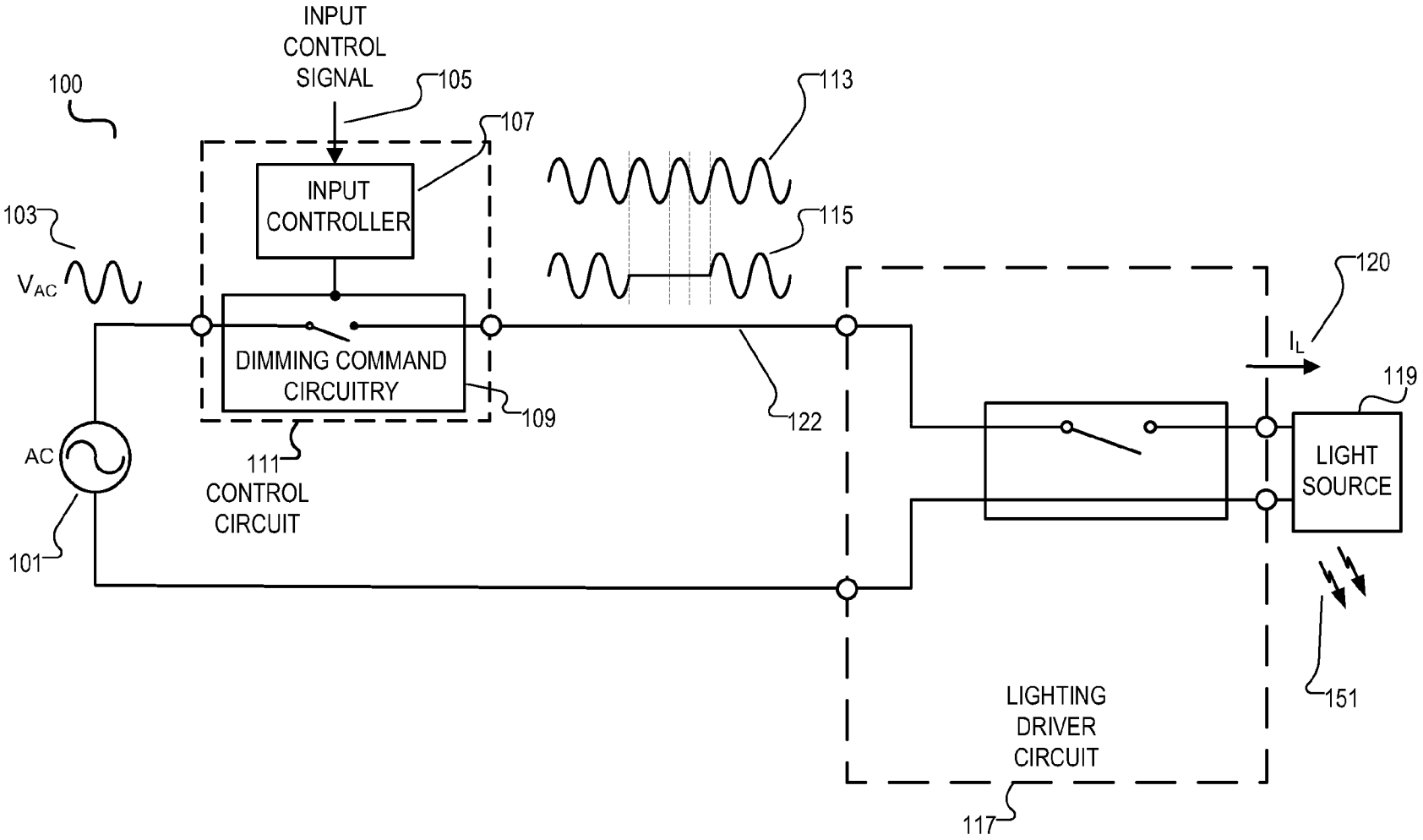
FIG. 1 is a schematic illustrating generally an example light driver control system including a lighting driver circuit coupled to receive an ac signal from a control circuit and the lighting driver circuit controlling a light source in response to the ac signal in accordance with the teachings of the present invention.

Methods and apparatuses for implementing a light driver control system are described. In the following description, numerous specific details are set forth in order to provide a thorough understanding of the present invention. It will be apparent, however, to one having ordinary skill in the art that the specific detail need not be employed to practice the present invention. In other instances, well-known materials or methods have not been described in detail in order to avoid obscuring the present invention.

Reference throughout this specification to "one embodiment", "an embodiment", "one example" or "an example" means that a particular feature, structure or characteristic described in connection with the embodiment or example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or subcombinations in one or more embodiments or examples. Particular features, structures or characteristics may be included in an integrated circuit, an electronic circuit, a combinational logic circuit, or other suitable components that provide the described functionality. In addition, it is appreciated that the figures provided herewith are for explanation purposes to persons ordinarily skilled in the art and that the drawings are not necessarily drawn to scale.

As summarized previously, alternatives to incandescent light bulbs are increasingly popular and are sold as "drop-in" replacements to be compatible with existing sockets, wiring, conventional light switches, and conventional dimmers. However, as previously mentioned, EMI, low power factor, and light flicker may be among the problems associated with using at least some alternative light sources with conventional dimmers.

As will be discussed in further detail below, examples of a system for controlling a light source in accordance with the teachings of the present invention provide a simple, low cost solution to provide dimming functionality using the existing wiring in the walls while reducing EMI and retaining high power factor. An example system includes a control circuit and a lighting driver circuit. In one example, the control circuit is coupled to the lighting driver circuit and the control circuit removes one or more portions of a predetermined duration from an ac signal and the lighting driver circuit receives the ac signal with the removed one or more portions of the predetermined duration from the control circuit followed by a substantially full ac signal waveform. The lighting driver circuit dims a light source in response to the one or more portions of the predetermined duration from the ac signal. In one example, the control circuit may have the form factor to be a "drop-in" replacement for a conventional dimmer. In one example, both the lighting driver circuit and a light source are combined into a single form factor compatible with existing lighting sockets to be a "drop-in" replacement for conventional light sources.

In one example, the lighting driver circuit may be compatible to be coupled to existing lighting sockets and the light source may be coupled to the lighting driver circuit. If the light source fails, the light source can be replaced, and therefore decoupled from the lighting driver circuit such that a new light source can be coupled to the lighting driver circuit. Or, if the lighting driver circuit fails, the lighting driver circuit can be replaced, and therefore decoupled from the existing lighting socket and light source such that a new lighting driver circuit can be coupled to the existing lighting socket and the light source.

To illustrate, FIG. 1 shows generally one example of a light driver control system 100 having a control circuit 111, a lighting driver circuit 117, and a light source 119 in accordance with the teachings of the present invention. As shown, control circuit 111 may be coupled to an ac source 101 and receive $V_{AC}$ 103. Control circuit 111 includes an input controller 107 and a dimming command circuitry 109. Input controller 107 is coupled to receive an input control signal 105 and coupled to dimming command circuitry 109. Dimming command circuitry 109 is coupled to receive $V_{AC}$ 103 and is coupled to remove one or more portions of an ac signal waveform of a predetermined duration from $V_{AC}$ 103 followed by a substantially full ac signal waveform in Vac 103 in response to input control signal 105. Control circuit 111 may be coupled to a single conductor 122 and lighting driver circuit 117 may be coupled to receive an ac signal such as example ac signal 113 or example ac signal 115 from control circuit 111 through single conductor 122.

Figure 2:
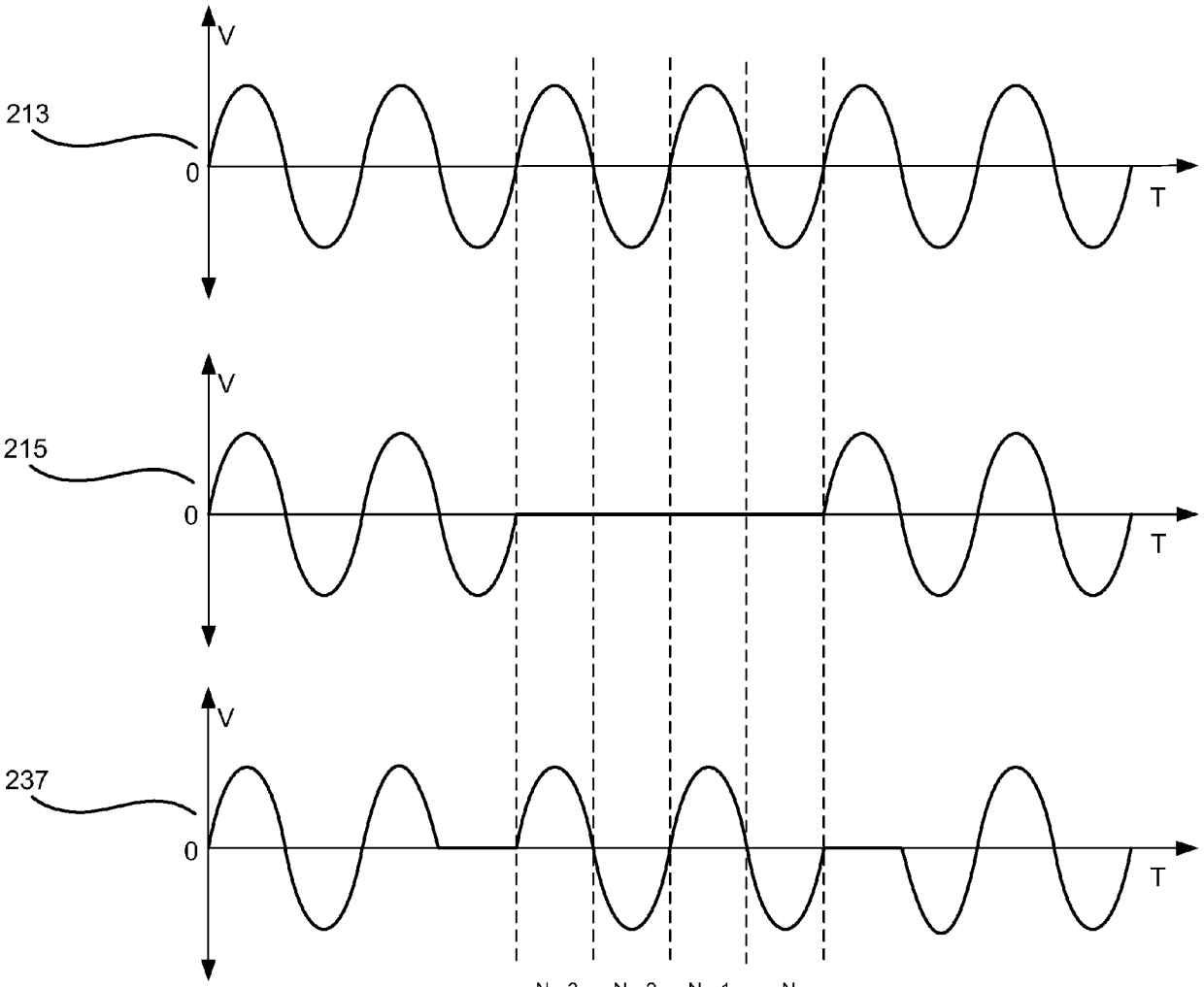
FIG. 2 shows generally ac signal waveforms as examples of an ac signal that may be received by the lighting driver circuit in accordance with the teachings of the present invention.

To illustrate, attention is directed to FIG. 2, which shows example ac signal waveforms that may be received by example lighting driver circuit 117 in accordance with the teachings of the present invention. In particular, FIG. 2 shows an ac signal waveform 213 in which no portions of ac signal waveform 213 have been removed from $V_{AC}$ 103 by dimming command circuitry 109. Ac signal waveform 213 may be representative of a "steady state" ac signal received by lighting driver circuit 117 when control circuit 111 is not removing portions from the ac signal in order to adjust a light output 151. In one example, ac signal waveform 213 may be representative of an ac signal received by the lighting driver circuit 117 if input control signal 105 has been set not to remove any portions from $V_{AC}$ 103. In one example, ac signal waveform 213 (with no removed portions) may correspond with a user setting input control signal 105 to maximize light output 151.

FIG. 2 also illustrates an ac signal waveform 215, which represents one example of an ac signal that may be received by lighting driver circuit 117 if input control signal 105 has been set to a particular light output 151 level. In the illustrated example, a portion of the ac signal waveform having a predetermined duration of four half cycles has been removed from the ac signal waveform of $V_{AC}$ 103 by the dimming command circuitry 109 followed by a substantially full ac signal waveform. In one example, a predetermined duration substantially equal to an integer number of half cycles of an ac signal is removed by using zero voltage switching where the ac signal is disconnected at the "zero crossing." Among the advantages of using zero voltage switching is the relatively simplistic hardware implementation. In addition, using zero voltage switching reduces EMI because when the voltage of the signal is at or near zero at the switching time, the energy is at or near zero. Thus, any EMI radiated as a result of switching is radiated at an energy level at or near zero. In contrast, triac-based dimmers generate sharp switching edges by "chopping" an ac signal at non-zero voltage levels.

The sharp switching edges generated by triac-based dimmers may also lower the power factor of energy grids. The sharp switching edges distort input current waveforms, which may increase the required infrastructure (such as capacitance and conductor size) to deliver power to the load. Hence, among the advantages of using zero voltage switching is substantially limiting sharp switching edges, and thus increasing the power factor of the energy grid.

In general, it is appreciated that the duration of the one or more portions removed from ac signal waveform 215 could be any predetermined duration to set the particular light output 151 level. In one example, the predetermined duration of the removed portion of ac signal waveform 215 may be substantially equal to an integer or non-integer number of half cycles removed from $V_{AC}$ 103. In examples described in this disclosure for explanation purposes, the multiple of half cycles removed from the ac signal waveform is substantially equal to an integer number N 219. In one example, the integer number N 219 of half cycles removed from $V_{AC}$ 103 may correspond with the particular light output 151 level. In one example, the greater the integer number N of half cycles removed from $V_{AC}$ 103, the dimmer light output 151 becomes. Similarly, the smaller the integer number N, the brighter light output 151 becomes. In one example, dimming command circuitry 109 removes an even integer number N of half cycles from $V_{AC}$ 103. Removing an even integer number N 219 of half cycles may prevent adding a dc offset to the ac signal. As will be discussed in further detail below, if integer number N 219 is too large, it may adversely affect user feedback.

FIG. 2 further illustrates an ac signal waveform 237, which represents another example of an ac signal that may be received by lighting driver circuit 117 if input control signal 105 has been set to indicate a particular light output 151 level. As shown in the illustrated example, the ac signal waveform is enabled between first and second portions of the ac signal waveform that are disabled for respective predetermined durations. In the example, the first portion indicates a "beginning of message" and the second portion indicates an "end of message" followed by a substantially full ac signal waveform. To illustrate, in the specific example of ac signal waveform 237, dimming command circuitry 109 has removed a first portion of the ac signal waveform having a predetermined duration substantially equal to one half cycle. Then, four half cycles of the ac signal are enabled. Then, dimming command circuitry 109 has removed a second portion of the ac signal waveform having a predetermined duration substantially equal to one half cycle followed by a substantially full ac signal waveform in $V_{AC}$ 103. In the example, the first portion that has been removed represents a "beginning of message," the enabled four half cycles represents a particular light output 151 level, and the second portion that has been removed represents an "end of message." It is appreciated of course that the respective predetermined durations of the removed and enabled portions of the ac signal waveform in $V_{AC}$ 103 may be any integer or non-integer number of half cycles of the ac signal waveform in accordance with the teachings of the present invention. As can be appreciated to one having the benefit of this disclosure, there are many ways to encode bits or information to communicate a light output 151 level and the above examples described above for explanation purposes are just some of the ways to transmit data by removing one or more portions having predetermined durations of the ac signal waveform from $V_{AC}$ 103 to set the particular light output 151 level in accordance with the teachings of the present invention.

Referring now back to FIG. 1, lighting driver circuit 117 may be coupled to receive ac signals from control circuit 111 and example ac signal 113 and example ac signal 115 are illustrated to be representative of ac signals that may be received by lighting driver circuit 117. Lighting driver circuit 117 may be coupled to ac source 101 and may be coupled to drive light source 119 to have light output 151 adjusted in response to an ac signal received from control circuit 111. In one example, the lighting driver circuit adjusts light output 151 of light source 119 by controlling a current $I_L$ 120.

Continuing with the system illustrated in FIG. 1, in one example, control circuit 111 removes portion having a duration substantially equal to an integer number N of half cycles corresponding to input control signal 105 from $V_{AC}$ 103 only upon a change in input control signal 105. For instance, in this example, the control circuit may remove a portion having a duration substantially equal to four half cycles from $V_{AC}$ 103 in response to a change in input control signal 105, and after removing the four half cycles, control circuit 111 would not remove further half cycles from $V_{AC}$ 103 unless input control signal 105 changes. In one example, control circuit 111 periodically removes an integer number N of half cycles corresponding with the input control signal. For instance, in this example, the control circuit 111 may remove four half cycles from $V_{AC}$ 103 upon a first change in input control signal 105 and continue removing four half cycles from $V_{AC}$ 103 periodically (e.g. every ten seconds) until a second change in input control signal 105, in which case control circuit 111 will periodically remove an integer number of half cycles from $V_{AC}$ 103 that corresponds with the second change in input control signal 105. It is appreciated that the examples described in this paragraph are not limited to signal waveforms similar to ac signal waveform 215, but the examples also may include waveforms similar to ac signal waveform 237, different sequences of removed and enabled portions of the ac signal waveform, and/or variable integer or non-integer numbers of removed or enabled half cycles, as described in this disclosure.

As discussed above, zero voltage switching in one example may be advantageous for EMI and power factor reasons. Additionally, when portions of the ac signal waveform are removed only periodically or upon a change in input control signal 105 in accordance with the above examples, overall switching of the ac signal is drastically reduced in comparison to triac "chopping" where switching takes place on every ac cycle. A reduction in overall switching further reduces EMI and increases power factor compared to triac-based dimmers. Furthermore, when portions of the ac signal waveform are removed only periodically or upon a change in input control signal 105, light sources are not starved for power in low light conditions. Rather, a "steady state" ac signal similar to ac signal waveform 213 may be received by lighting driver circuit 117 a majority of the time giving lighting driver circuit 117 sufficient power to deliver to light source 119 without generating light flicker.

In one example in which the portions of the ac signal waveform that are removed have a predetermined duration substantially equal to an integer number of half cycles, the maximum integer number of half cycles removed from $V_{AC}$ 103 by control circuit 111 is less than one half of a cycles per second of $V_{AC}$ 103. For instance, if $V_{AC}$ 103 is a 60 Hertz (Hz) signal, (that is 60 cycles per second), then the maximum integer number of half cycles removed from $V_{AC}$ 103 would equal 29 (29=(60 Hz*½)−1). Similarly, if $V_{AC}$ 103 is a 50 Hz signal, then maximum integer number of half cycles removed from $V_{AC}$ would equal 24. Of course, these numbers are provided only for explanation purposes, and other numbers may be utilized while still benefiting from the teachings of the present invention. Continuing with the example, visual feedback (in the form of light output 151) will reach the user adjusting input control signal 105 in approximately 250 ms (29/120 half cycles per second in a 60 Hz signal). In one example, the maximum integer number of half cycles removed from $V_{AC}$ 103 may be less than one fifth of a cycles per second of $V_{AC}$ 103. In this example, the visual feedback would reach the user in approximately 100 ms. One reason to restrict the number of half cycles removed from $V_{AC}$ 103 by control circuit 111 is to give timely visual feedback to a user adjusting input control signal 105. Then, if the dimming command circuitry 109 removes an integer number of half cycles from $V_{AC}$ upon changing input control signal 105 in order to adjust light output 151 of a light source 119, the user will have timely visual feedback while changing input control signal 105.

Figure 3:
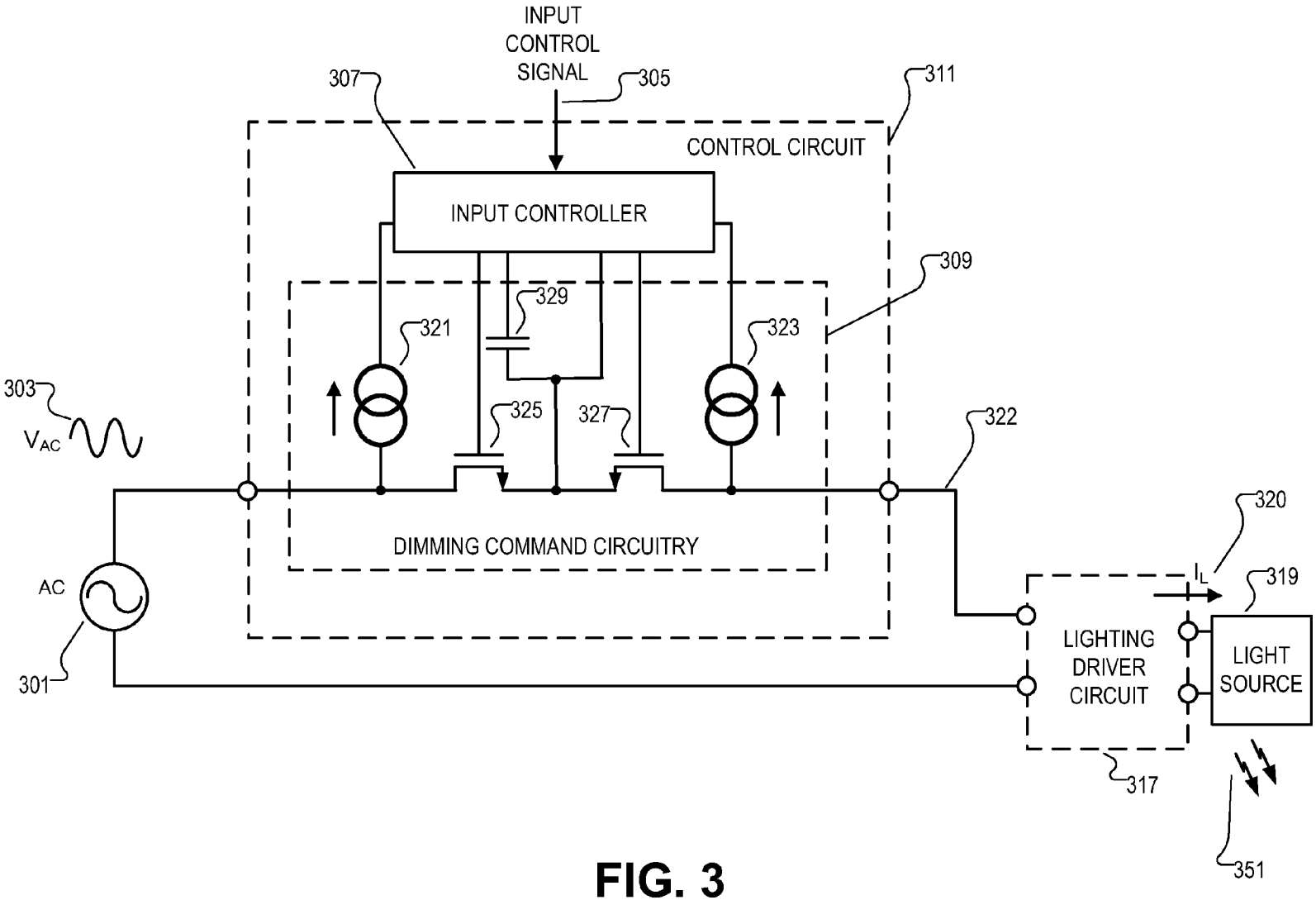
FIG. 3 is a schematic illustrating a light driver control system with one example of a control circuit in accordance with the teachings of the present invention.

FIG. 3 shows one example of a control circuit 311 that includes an input controller 307 coupled to receive an input control signal 305 and includes a dimming command circuitry 309, which is coupled to input controller 307. In one example, dimming command circuitry 309 removes an integer number of half cycles from $V_{AC}$ 303 in response to input control signal 305.

In one example, dimming command circuitry 309 includes a bi-directional switch illustrated by an N-channel FET 325 and an N-channel FET 327. It is appreciated that those skilled in the art may choose a device other than a FET to use as a switch. The gates of N-channel FET 325 and N-channel FET 327 are independently coupled to input controller 307 and the source of N-channel FET 325 is coupled to the source of N-channel FET 327. A bypass capacitor 329 is coupled to input controller 307 and may decouple a supply voltage to input controller 307. As shown in the depicted example, bypass capacitor 329 is also coupled to the sources of both N-channel FET 325 and N-channel FET 327. A current source 321 is coupled to input controller 307 and is coupled to the drain of N-channel FET 325. Current source 321 is also coupled to receive $V_{AC}$ 303. A current source 323 is coupled to input controller 307 and is coupled to the drain of N-channel FET 327. Current source 323 and the drain of N-channel FET 327 are coupled to output the ac signal through single conductor 322. The current from both current source 321 and current source 323 flows toward input controller 307.

In one example, all circuitry shown within control circuit 311 is included in an integrated circuit. In another example, all circuitry except bypass capacitor 329 is included in an integrated circuit. In still another example, all circuitry within the control circuit is included in an integrated circuit except bypass capacitor 329, N-channel FET 325, and N-channel FET 327.

Figure 4:
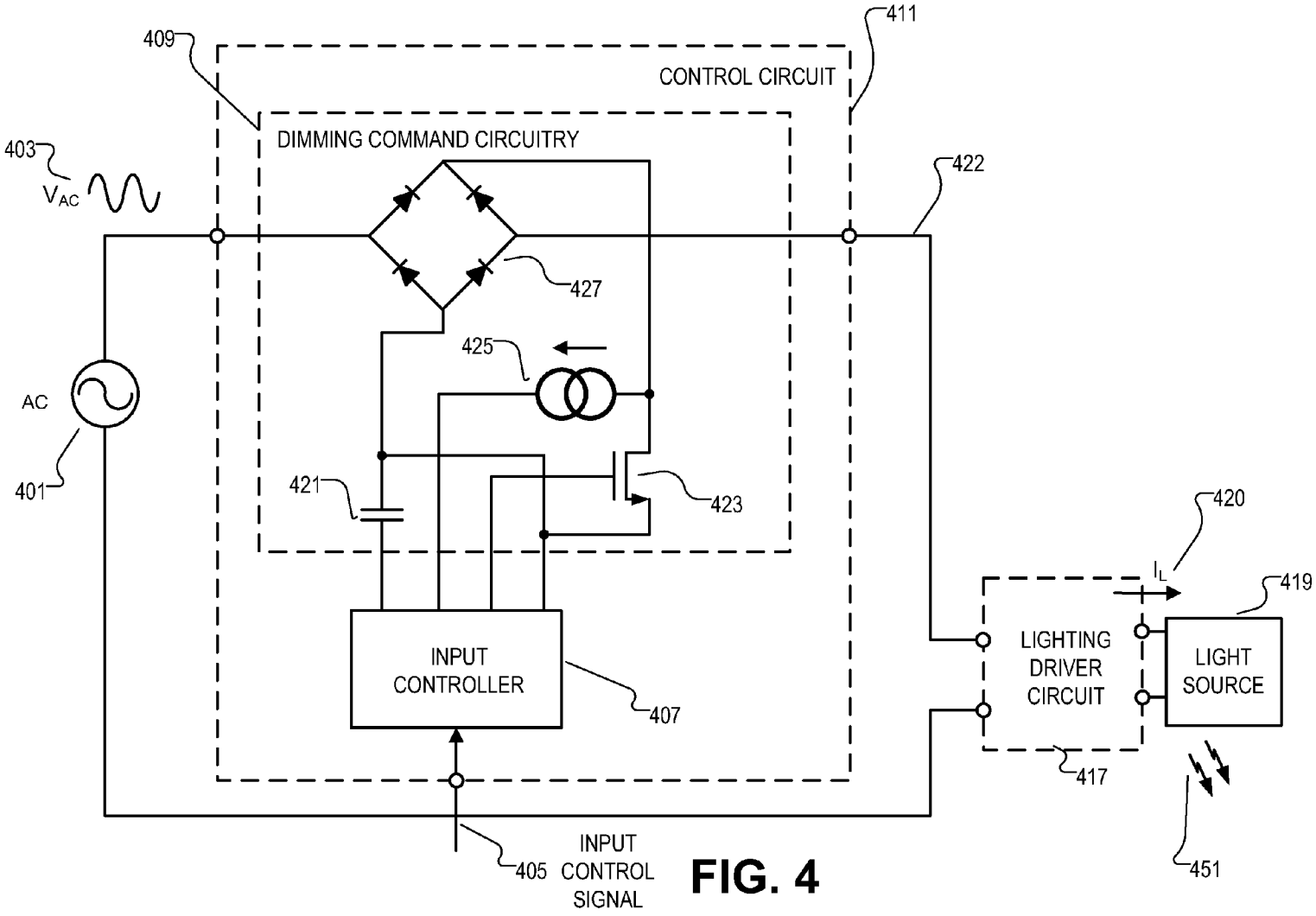
FIG. 4 is a schematic illustrating a light driver control system with another example of a control circuit in accordance with the teachings of the present invention.

FIG. 4 shows one example of a control circuit 411 that includes an input controller 407 coupled to receive an input control signal 405 and includes a dimming command circuitry 409, which is coupled to input controller 407. Dimming command circuitry 409 includes rectifier 427, which is coupled to receive $V_{AC}$ 403 and output an ac signal through single conductor 422. Dimming command circuitry 409 also includes a uni-directional switch illustrated by N-channel FET 423, current source 425, and bypass capacitor 421. As shown in the depicted example, the gate of N-channel FET 423 is coupled to input controller 407, the source of N-channel FET 423 is coupled to input controller 407 and the node of rectifier 427 where two anodes connect. The drain of N-channel FET 423 is coupled to the node of rectifier 427 where two cathodes connect. Bypass capacitor 421 is coupled to the source of N-channel FET 423, the node of rectifier 427 where two anodes connect, and input controller 407. Bypass capacitor 421 may decouple a supply voltage to input controller 407. Current source 425 is coupled to the drain of N-channel FET 423 and input controller 407.

In one example, all circuitry shown within control circuit 411 may be included in an integrated circuit. In another example, all circuitry except bypass capacitor 421 may be included in an integrated circuit. In still another example, all circuitry within the control circuit may be included in an integrated circuit except bypass capacitor 421 and N-channel FET 423.

Figure 5B:
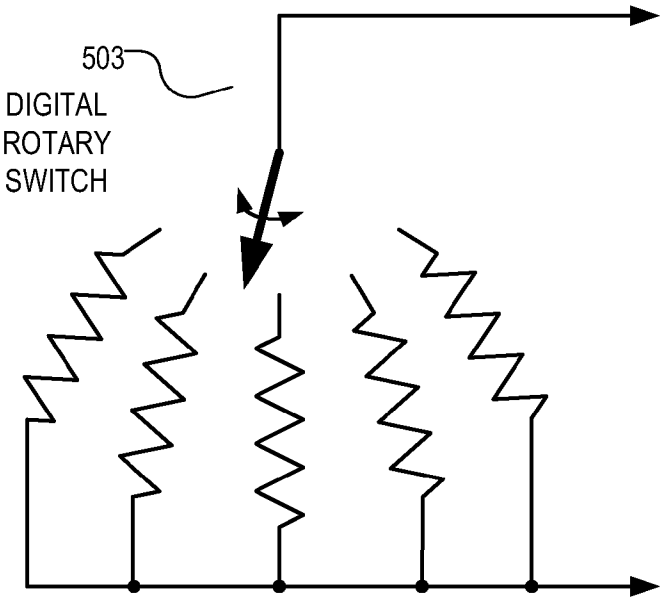
FIGS. 5A and 5B shows an analog slider and a digital rotary switch as examples of hardware coupled to generate an input control signal received by a control circuit in accordance with the teachings of the present invention.
Figure 5A:
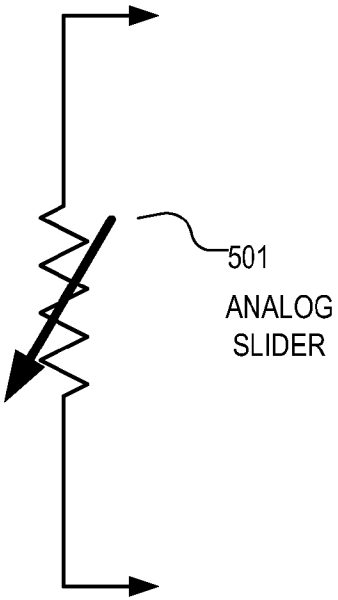

FIGS. 5A and 5B show an analog slider 501 and a digital rotary switch 503 as examples of hardware that may be coupled to input controller 107 to generate input control signal 105 as shown for example in FIG. 1. Analog slider 501 would generate an analog input control signal 105 based on the position of the slider. Digital rotary switch 503 would generate a digital input control signal 105 based on the discrete position of the rotary switch.

Figure 6:
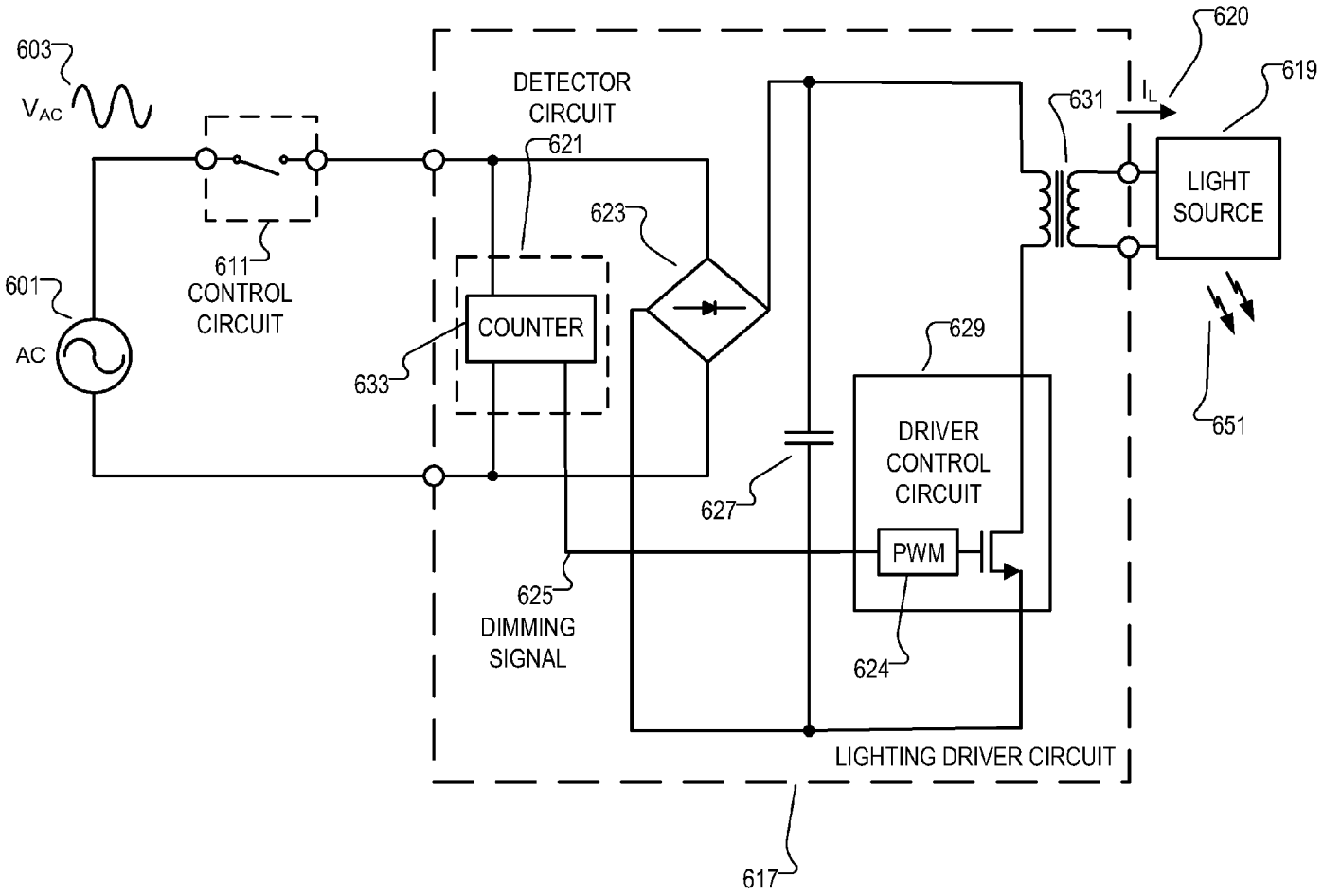
FIG. 6 is a schematic illustrating a light driver control system with one example of a lighting driver circuit in accordance with the teachings of the present invention.

FIG. 6 shows one example of a lighting driver circuit 617 that includes example detector circuit 621, a driver control circuit 629, a rectifier 623, a capacitor 627, and an energy transfer element 631. As shown in the depicted example, detector circuit 621 is coupled to receive an ac signal such as example ac signal 113 or example ac signal 115 from a control circuit 611 and coupled to output a dimming signal in response to the integer number of half cycles removed from or enabled in the ac signal by control circuit 611. Driver control circuit 629 receives a dimming signal 625 from detector circuit 621 and adjusts a light output 651 of a light source 619 in response to the dimming signal 625. As shown in FIG. 6, one example of driver control circuit 629 includes a PWM driver 624. Example detector circuit 621 includes a counter 633 coupled to count the number of half cycles removed from or enabled in the ac signal by control circuit 611. In one example, driver control circuit 629 adjusts the light output 651 of the light source 619 by adjusting a current IL 620 flowing through light source 619. In one example, rectifier 623 is coupled to receive the ac signal from control circuit 611 and rectify the ac signal. Capacitor 627 is coupled to rectifier 623 and coupled to energy transfer element 631. In one example, capacitor 627 may substantially smooth the rectified ac signal. In another example, detector circuit 621 and driver control circuit 629 are included in an integrated circuit. In still another example, detector circuit 621 and PWM driver 624 are included in an integrated circuit.

Figure 7:
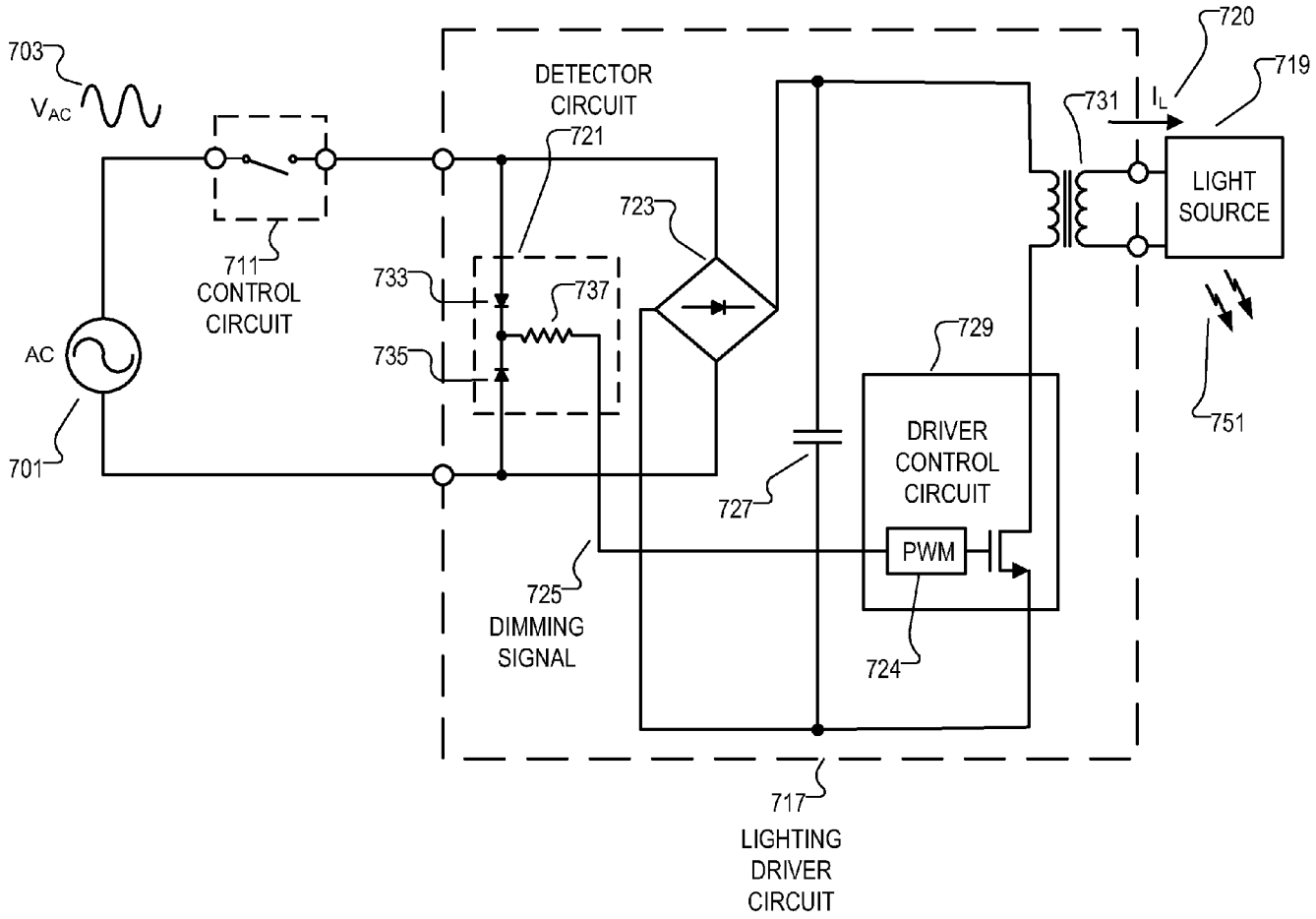
FIG. 7 is a schematic illustrating a light driver control system with another example of a lighting driver circuit in accordance with the teachings of the present invention.

FIG. 7 shows one example of a lighting driver circuit 717 that includes example detector circuit 721, a driver control circuit 729, a rectifier 723, a capacitor 727, and an energy transfer element 731. In the depicted example, detector circuit 721 is coupled to receive an ac signal such as example ac signal 113 or example ac signal 115 from the control circuit 711 and coupled to output a dimming signal 725 in response to the integer number of half cycles removed from or enabled in the ac signal by control circuit 711. Driver control circuit 724 receives dimming signal 725 from detector circuit 721 and adjusts a light output 751 of a light source 719 in response to the dimming signal 725. As shown in FIG. 7, one example of driver control circuit 729 includes a PWM driver 724. Example detector circuit 721 includes a diode 733 coupled to receive the ac signal from control circuit 711, a diode 735 coupled to diode 733, and a resistor 737 coupled to the cathodes of diode 733 and diode 735. The dimming signal 725 output by detector circuit 721 may be a current representative of a value of a voltage of the ac signal received from the control circuit 711. In one example, driver control circuit 729 adjusts the light output 751 of the light source 719 by adjusting a current IL 720 flowing through light source 719. In one example, rectifier 723 is coupled to receive the ac signal from control circuit 711 and rectify the ac signal. Capacitor 727 is coupled to rectifier 723 and coupled to energy transfer element 731. In one example, capacitor 727 may substantially smooth the rectified ac signal. In another example, detector circuit 721 and driver control circuit 729 are included in an integrated circuit. In still another example, detector circuit 721 and PWM driver 724 are included in an integrated circuit.

Figure 8:
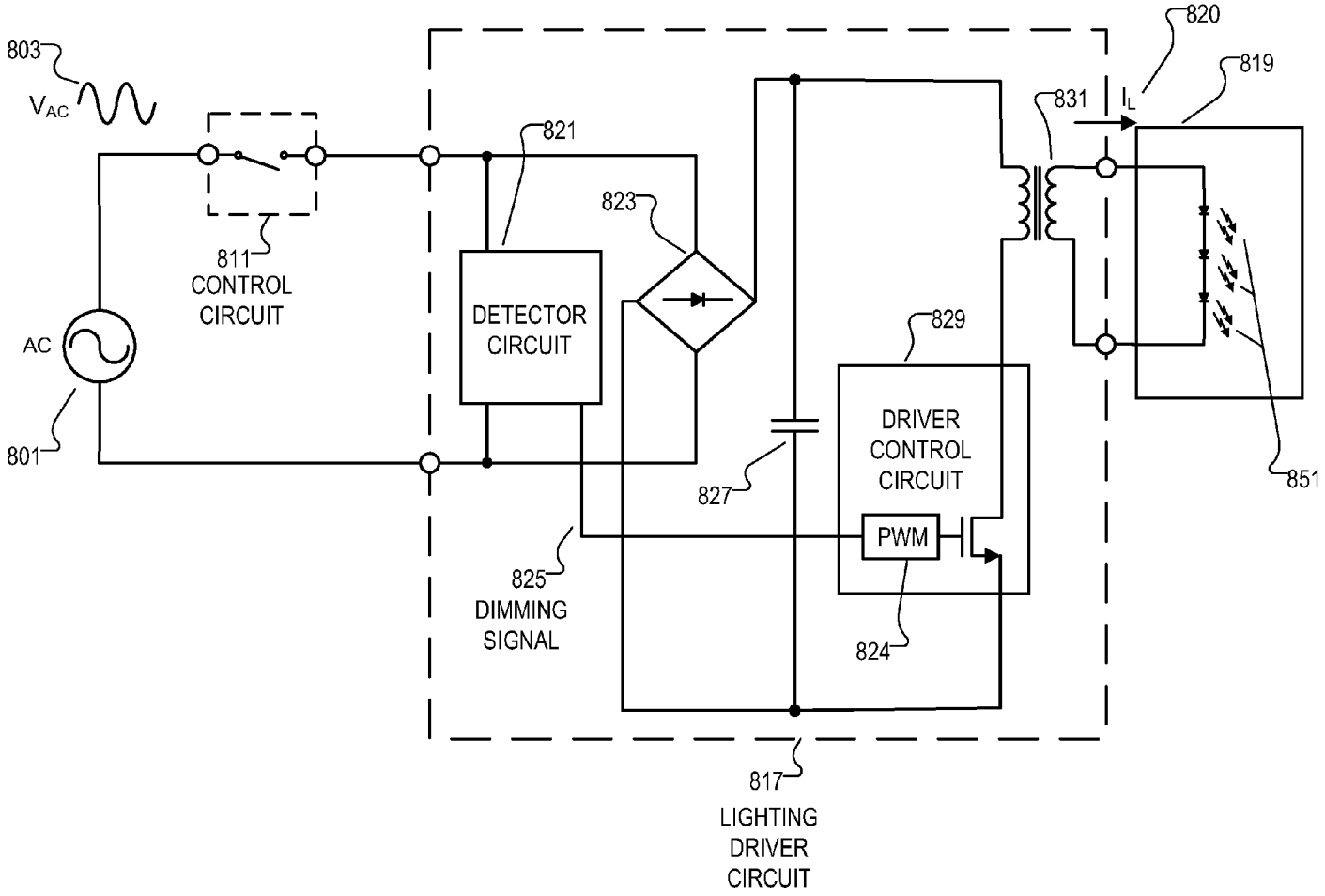
FIG. 8 is a schematic illustrating a light driver control system with one example of a light source in accordance with the teachings of the present invention.

FIG. 8 shows one example of a lighting driver circuit 817 that includes example detector circuit 821, a driver control circuit 829, a rectifier 823, a capacitor 827, and an energy transfer element 831. In the depicted example, detector circuit 821 is coupled to receive an ac signal such as example ac signal 113 or example ac signal 115 from a control circuit 811 and coupled to output a dimming signal 825 in response to the integer number of half cycles removed from or enabled in the ac signal by control circuit 811. Driver control circuit 829 receives dimming signal 825 from detector circuit 821 and adjusts a light output 851 of a light source 819 in response to the dimming signal 825. As shown in FIG. 8, one example of driver control circuit 829 includes a PWM driver 824. In the depicted example, detector circuit 821 may include the embodiments of example detector circuit 621 of FIG. 6 or example detector circuit 721 of FIG. 7. In one example, driver control circuit 829 adjusts the light output 851 of the light source 819 by adjusting a current IL 820 flowing through light source 819. In one example, rectifier 823 is coupled to receive the ac signal from control circuit 811 and rectify the ac signal. Capacitor 827 is coupled to rectifier 823 and coupled to energy transfer element 831. In one example, capacitor 827 may substantially smooth the rectified ac signal.

The above description of illustrated examples of the present invention, including what is described in the Abstract, are not intended to be exhaustive or to be limitation to the precise forms disclosed. While specific embodiments of, and examples for, the invention are described herein for illustrative purposes, various equivalent modifications are possible without departing from the broader spirit and scope of the present invention. Indeed, it is appreciated that the specific voltages, currents, frequencies, power range values, times, etc., are provided for explanation purposes and that other values may also be employed in other embodiments and examples in accordance with the teachings of the present invention.

These modifications can be made to examples of the invention in light of the above detailed description. The terms used in the following claims should not be construed to limit the invention to the specific embodiments disclosed in the specification and the claims. Rather, the scope is to be determined entirely by the following claims, which are to be construed in accordance with established doctrines of claim interpretation. The present specification and figures are accordingly to be regarded as illustrative rather than restrictive.

What is claimed is:

1. A system for controlling a light source, comprising:

a control circuit to be coupled to an ac source to receive an ac signal, the control circuit including an input controller coupled to receive an input control signal, the control circuit further including dimming command circuitry coupled to the input controller and coupled to receive the ac signal, the dimming command circuitry coupled to remove one or more portions of a predetermined duration from the ac signal followed by a substantially full ac signal in response to the input control signal, wherein the predetermined duration is substantially equal to an even integer number N of half cycles of the ac signal, and wherein the dimming command circuitry is coupled to remove an even integer number N of successive half cycles from the ac signal in response to the input control signal; and a lighting driver circuit to be coupled to a light source and coupled to receive the ac signal from the control circuit, the lighting driver circuit coupled to drive the light source to have a light output adjusted in response to the removed one or more portions of the predetermined duration from the ac signal by the dimming command circuitry.

2. The system of claim 1, wherein the dimming command circuitry is coupled to output the ac signal with half cycles between removed first and second portions of the predetermined duration from the ac signal, wherein the lighting driver circuit is coupled to drive the light source to have the light output further adjusted in response to a number of the enabled half cycles between the removed first and second portions of the predetermined duration from the ac signal by the dimming command circuitry.

3. The system of claim 1 further comprising an analog slider coupled to generate the input control signal coupled to be received by the input controller.

4. The system of claim 1 further comprising a digital rotary switch coupled to generate the input control signal coupled to be received by the input controller.

5. The system of claim 1, wherein the dimming command circuitry comprises a bi-directional switch coupled to the input controller and coupled to receive the ac signal, wherein the bi-directional switch is coupled to remove the even integer number N of successive half cycles from the ac signal in response to the input control signal.

6. The system of claim 1, wherein the dimming command circuitry comprises:

a rectifier coupled to receive the ac signal; and a uni-directional switch coupled to the rectifier and coupled to the input controller, wherein the rectifier and the uni-directional switch are coupled to remove the even integer number N of successive half cycles from the ac signal in response to the input control signal.

7. The system of claim 1, wherein the lighting driver circuit comprises:

a detector circuit coupled to receive the ac signal from the control circuit, the detector circuit coupled to output a dimming signal in response to the even integer number N of successive half cycles removed from the ac signal by the dimming command circuitry; and a driver control circuit coupled to receive the dimming signal from the detector circuit, the driver control circuit coupled to adjust the light output of the light source in response to the dimming signal.

8. The system of claim 7, wherein the detector circuit comprises a first diode coupled to receive the ac signal from the control circuit, a second diode coupled to the first diode, and a resistor coupled to the first and second diodes, and wherein the dimming signal is coupled to be output from the detector circuit is a current representative of a value of a voltage of the ac signal from the control circuit.

9. The system of claim 7, wherein the detector circuit comprises a counter coupled to count the even integer number N of successive half cycles removed from the ac signal by the dimming command circuitry.

10. The system of claim 1, wherein the light source is an LED light source, and wherein the lighting driver circuit is coupled to control a current flowing through the LED light source in response to the even integer number N of successive half cycles removed from the ac signal by the dimming command circuitry.

11. The system of claim 1, wherein the lighting driver circuit is coupled to receive the ac signal from the control circuit through a single conductor.

12. The system of claim 1, wherein the even integer number N of successive half cycles removed from the ac signal by the dimming command circuitry is less than half of a cycles per second of the ac signal.

13. A control circuit for controlling a light source, comprising:

an input controller coupled to receive an input control signal; and dimming command circuitry coupled to the input controller and further coupled to receive an ac signal, the dimming command circuitry coupled to remove one or more even integer number N of successive half cycles from the ac signal followed by a substantially full ac signal in response to the input control signal and further coupled to output the ac signal to a lighting driver circuit coupled to the light source, the control circuit to be coupled between an ac source and the lighting driver circuit;

wherein the dimming command circuitry is coupled to enable half cycles between the removed even integer number N of successive half cycles of the ac signal, wherein the enabled half cycles between the removed even integer number N of successive half cycles of the ac signal indicate to the lighting driver circuit a light output of the light source.

14. The control circuit of claim 13 further comprising an analog slider coupled to generate the input control signal coupled to be received by the input controller.

15. The control circuit of claim 13 further comprising a digital rotary switch coupled to generate the input control signal coupled to be received by the input controller.

16. The control circuit of claim 13, wherein the dimming command circuitry comprises a bi-directional switch coupled to the input controller and coupled to receive the ac signal, wherein the bi-directional switch is coupled to remove the even integer number N of successive half cycles from the ac signal in response to the input control signal.

17. The control circuit of claim 13, wherein the dimming command circuitry comprises:

a rectifier coupled to receive the ac signal; and a uni-directional switch coupled to the rectifier and coupled to the input controller, wherein the rectifier and the uni-directional switch are coupled to remove the even integer number N of successive half cycles from the ac signal in response to the input control signal.

18. The control circuit of claim 13, wherein the even integer number N of successive half cycles removed by the dimming command circuitry is less than half of a cycles per second of the ac signal.

19. The control circuit of claim 13, wherein the light source is an LED light source, and wherein the lighting driver circuit adjusts a current flowing through the LED light source in response to the even integer number N of successive half cycles removed from the ac signal by the dimming command circuitry.

20. A lighting driver circuit for driving a light source, comprising:

a detector circuit coupled to receive an ac signal from a control circuit, the detector circuit coupled to output a dimming signal and adjust the dimming signal in response to one or more portions of a predetermined duration removed from the ac signal followed by a substantially full ac signal by the control circuit;

a driver control circuit coupled to receive the dimming signal from the detector circuit, the driver control circuit coupled to adjust a light output of the light source in response to the dimming signal, the lighting driver circuit to be coupled to the light source;

wherein the predetermined duration is substantially equal to an integer number N of half cycles of the ac signal; wherein the detector circuit is coupled to receive an even integer number N of half cycles removed from the ac signal; and wherein the detector circuit is coupled to receive enabled half cycles between first and second portions of the predetermined duration removed from the ac signal and adjust the dimming signal in response to a number of the enabled half cycles between the first and second portions of the predetermined duration removed from the ac signal by the control circuit.

21. The lighting driver circuit of claim 20, wherein the detector circuit comprises a first diode coupled to receive the ac signal from the control circuit, a second diode coupled to the first diode, and a resistor coupled to the first and second diodes, and wherein the dimming signal coupled to be output from the detector circuit is a current representative of a value of a voltage of the ac signal from the control circuit.

22. The lighting driver circuit of claim 20, wherein the detector circuit comprises a counter coupled to count the integer number N of half cycles removed from the ac signal by the control circuit.

23. The lighting driver circuit of claim 20 further comprising:

a rectifier coupled to receive the ac signal from the control circuit and coupled to output a rectified ac signal;

a capacitor coupled to the rectifier; and an energy transfer element coupled to the capacitor and coupled to drive the light source.

24. The lighting driver circuit of claim 20, wherein the light source is an LED light source, and wherein the driver control circuit is coupled to adjust a current flowing through the LED light source in response to the one or more portions of the predetermined duration removed from the ac signal by the control circuit.

25. The lighting driver circuit of claim 20, wherein the detector circuit is coupled to receive the ac signal from the control circuit through a single conductor.

26. The lighting driver circuit of claim 20, wherein the integer number N of half cycles removed from the ac signal by the control circuit is less than half of a cycles per second of the ac signal.

* * * * *